US005095809A

United States Patent [19]

Kröger

[11] Patent Number: 5,095,809

[45] Date of Patent: Mar. 17, 1992

[54] PISTON VIBRATOR HAVING AN ASYMMETRIC CYLINDRICAL BORE

[75] Inventor: Dietrich Kröger, Wiesbaden, Fed. Rep. of Germany

[73] Assignee: Netter GmbH, Wiesbaden, Fed. Rep. of Germany

[21] Appl. No.: 522,158

[22] Filed: May 11, 1990

[30] Foreign Application Priority Data

May 13, 1989 [DE] Fed. Rep. of Germany ..... 3915773

[51] Int. Cl.[5] ..... F01B 31/00

[52] U.S. Cl. ..... 92/163; 92/169.1; 92/165 PR; 92/261; 366/124; 91/218

[58] Field of Search ..... 366/124, 125, 126; 92/163, 164, 169.1, 177, 165 PR, 261; 29/888.02; 285/178; 403/5, 15; 91/218

[56] References Cited

U.S. PATENT DOCUMENTS

| | | | |
|---|---|---|---|
| 763,502 | 6/1904 | McCain | 92/163 |
| 795,970 | 8/1905 | Hall | 366/125 |
| 2,580,747 | 1/1952 | Feucht | 92/163 |
| 2,987,046 | 6/1961 | Atherton | 92/163 |
| 4,191,093 | 3/1980 | Compton | 92/169.1 |

FOREIGN PATENT DOCUMENTS

| | | | |
|---|---|---|---|
| 2448652 | 10/1980 | France | 92/169.1 |

*Primary Examiner*—Edward K. Look
*Assistant Examiner*—Thomas Denion
*Attorney, Agent, or Firm*—Michael L. Dunn; James F. Mudd

[57] ABSTRACT

The invention relates to a piston vibrator comprising a case with at least one cylindrical bore (5), at least one air connection (7) taken laterally to the bore (5), and a piston (2) longitudinally displaceable in the bore (5). As a means of making such a vibrator more efficient with a given outside diameter, or as a means of making it more compact and smaller with the same degree of efficiency, the invention proposes that the cylindrical bore (5) should extend asymmetrically to the external wall area (6) of the case, at least at the axial level of the air connection (7).

30 Claims, 2 Drawing Sheets

PISTON VIBRATOR HAVING AN ASYMMETRIC CYLINDRICAL BORE

Figure 1:
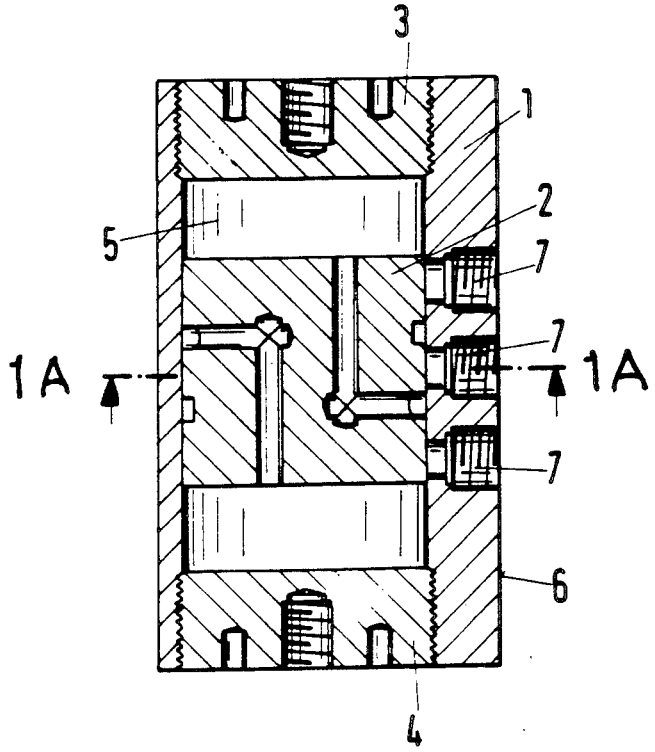

The invention relates to a piston vibrator comprising a case with at least one cylindrical bore and at least one air connection taken laterally to the bore, and a piston longitudinally displaceable in the bore.

Piston vibrators of this type have many possible applications, particularly in cases where bulk goods have to be compressed, e.g. in the packaging industry, or in the production and compression of cast parts, e.g. parts made of concrete or similar material. In all these applications piston vibrators are regarded as necessary and appropriate components of the machine in which they are mounted, although on some occasions they take up too much space and are troublesome. This may sometimes lead to the use of smaller and less efficient vibrators than would be desirable to achieve the required result. For this reason there is a need to make piston vibrators with given outside dimensions more efficient, or conversely to make piston vibrators of a given efficiency more compact.

The performance of a piston vibrator depends substantially only on the cross-sectional area of the bore and the weight of the piston. The weight in turn depends on this cross-sectional area and the length of the piston, which is in turn limited by the length of the piston vibrator less the piston stroke and the wall thickness of the cover and base of the vibrator case.

In practice a large number of case and piston diameters are required and also a large number of different lengths with the same diameter, so piston vibrators are still made in relatively large numbers as turned parts. The vibrator cases therefore have a generally more or less cylindrical shape. At least one air connection is provided laterally in the cylindrical wall of such a case, depending on the type of vibrator. As such vibrators are operated at considerable pressures of up to 10 bars or more, the air connection must be appropriately pressure proof, and the case wall in which it is mounted must therefore have a certain minimum thickness. Such an air connection generally comprises a bore with internal screw thread, although other possible air connections also require the vibrator case to have a certain minimum wall thickness. Commercial hose nozzles, for example, have a predetermined length of thread. So in known piston vibrators, particularly if they are produced as turned parts, the vibrator case substantially comprises a hollow cylinder with a base, cover and appropriate air connections. The cylinder has a relatively thick wall, in order to make the air connections pressure proof and/or for adaptation to predetermined standards. The total diameter of the piston vibrator is thus the diameter of the cylindrical bore plus the double wall thickness. Particularly in the case of relatively small vibrators with outside diameters in the range of 5 cm and below therefore, the total diameter will be determined substantially by the wall thickness of the case, which in practice is within the range of about 10 mm and over.

The efficiency of piston vibrators thus decreases rapidly if the outside diameter of the case is decreased, since the wall thickness is kept substantially constant, whereas performance drops with the square of the diameter of the cylindrical bore. For example, if the wall is 10 mm thick and the outside vibrator diameter is reduced from 50 to 40 mm, then the diameter of the cylindrical bore will be reduced from 30 to 20 mm and the performance of the vibrator will drop by a factor of $(3/2)^2=2.25$.

The problem of the invention is thus to provide a piston vibrator which has greater efficiency for a given outside diameter, or which is more compact and smaller in construction for a given degree of efficiency.

The problem is solved, in that the cylindrical bore extends asymmetrically to the external wall area of the case, at least at the axial level of the air connection.

A piston vibrator has one or more air connections in the lateral wall of the case, depending on the type of construction. As already mentioned, these connections require a certain minimum wall thickness. If the external wall of the case is asymmetric or eccentric relative to the inner cylindrical bore in the region of the air connections, then the wall thickness in the region of the air connections can firstly be made adequate for the standard screw thread to be used. Secondly, the wall thickness in the rest of the case can be reduced so that the total diameter of the case becomes smaller for a given diameter of the cylindrical bore, or the diameter of the cylindrical bore can be enlarged if the total diameter of the case can remain unchanged from an appropriate known construction.

In a preferred embodiment the outer wall area of the case is cylindrical substantially over its whole length. The inner cylindrical bore is then parallel with the axis of the cylindrical external wall of the case, but asymmetric and eccentric from that wall. In this way the wall thickness changes continuously round the periphery of the cylindrical bore, and the air connections are preferably provided in the region of the greatest wall thickness of the case.

In another embodiment the outer wall of the case is substantially cylindrical but also concentric with the inner cylindrical bore, and an eccentrically annular projection is only provided at the axial level of the air connection or connections.

An embodiment of this type is appropriate chiefly when only one lateral air connection has to be provided in the large diameter region of the bore, e.g. as in the case of differential pressure piston vibrators. With this embodiment the piston vibrator has a small, substantially constant wall thickness over most of its total length, and only in the region of the air connection or connections is the wall thickened by an eccentrically annular projection. The annular projection may end flush with the rest of the cylinder wall at the side opposite the air connection.

The first embodiment is envisaged preferably for piston vibrators in which the piston has a constant diameter and generally three lateral air connections. The second embodiment is appropriate mainly for differential pressure piston vibrators, in which the longitudinal section through the piston becomes thicker in steps, and which only require one lateral air connection in the region of the larger diameter of the base. In the latter case the greater wall thickness required for the air connection is restricted to a narrow, eccentrically annular projection, while the rest of the wall of the case is kept as thin as possible. In pistons with a substantially constant diameter and a plurality of lateral air connections in the region of the corresponding bore, such shaping is also possible, although it requires a plurality of annular projections or one very wide projection of this type. Hence the space saving achieved beyond the eccentric arrangement of the cylindrical bore is no longer so considerable.

The terms "piston with a substantially constant diameter" and "appropriate bore" include embodiments in which the piston and/or the bore have one or more grooves extending circularly for connection to air supply or air discharge bores.

Figure 1A:
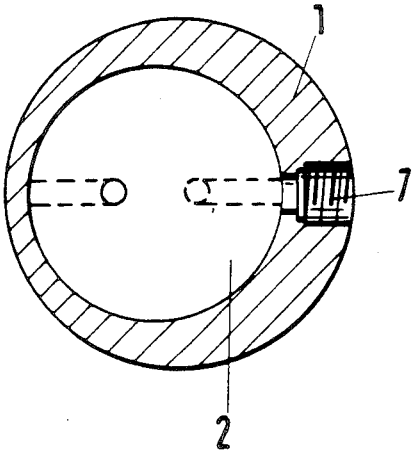
Figure 1B:
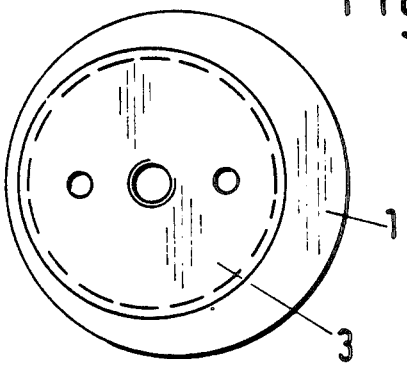
Figure 2:
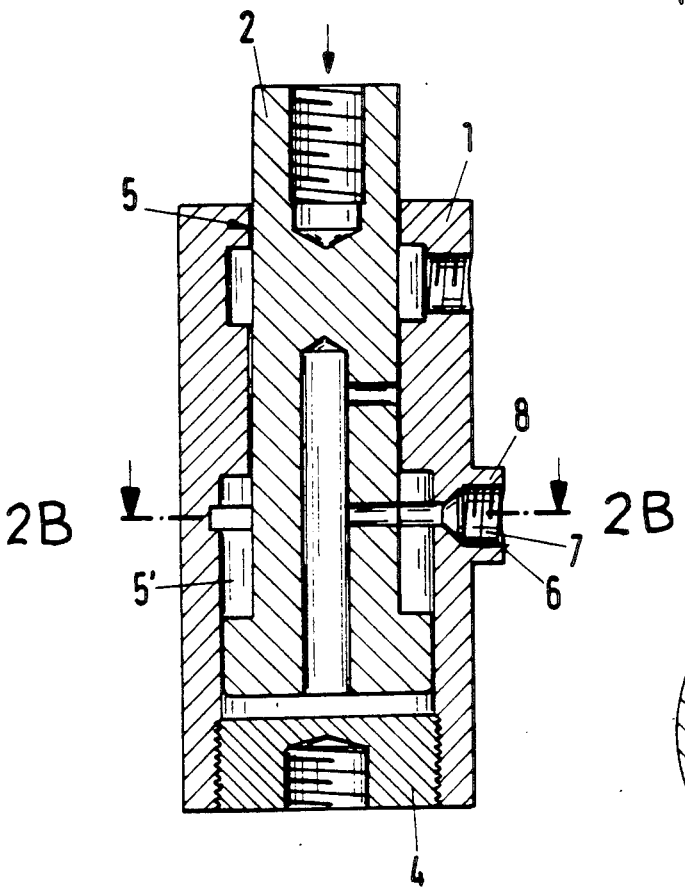
Figure 2A:
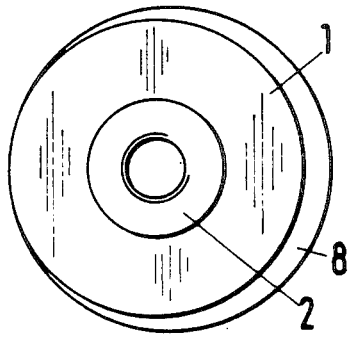
Figure 2B:
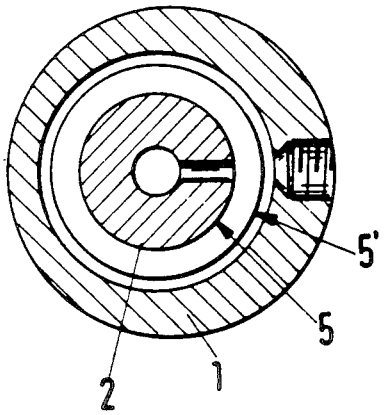
Figure 3:
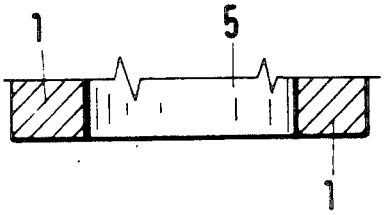
Fig.3 (PRIOR ART)

Other advantages, features and applications of the invention will become clear from the following description of preferred embodiments and the relevant drawings. In these:

FIGS. 1A and 1B are different views of a piston vibrator with a plurality of lateral air connections, FIGS. 2A and 2B are different views of a differential pressure piston vibrator with a lateral air connection in the region of the corresponding bore and FIG. 3 is a diagramatic section through a case of a conventional differential pressure piston vibrator corresponding to the FIG. 2 vibrator.

As shown in FIG. 1, the case of the piston vibrator comprises a wall 1, a cover 3 and a base 4. A piston 2 is axially displaceable in the cylindrical bore 5 and slides tightly in it. The piston 2 in turn has transverse and longitudinal bores and annular grooves to connect the chambers above and below it to corresponding air connections. The wall 1 of the vibrator case at the left hand side of FIG. 1 is clearly lower than that on the opposite side, where three air connections 7 are provided one behind the other in an axial direction. The difference in wall thickness results from the eccentric arrangement of the cylindrical bore 5 relative to the cylindrical outer wall area 6 of the case, as will be seen from FIGS. 1A and 1B. FIG. 1A is a section taken along lines A—A in FIG. 1, while FIG. 1B is a view of the piston vibrator from above. The cover 3 and base 4 are fixed in widened parts of the cylindrical bore 5, for example by screwing, soldering, adhesion or welding.

Compared with a conventional piston vibrator with a cylindrical inner bore of the same diameter and a constant (larger) wall thickness, the piston vibrator in FIG. 1 is about 15% smaller in diameter. On the other hand, if one takes a predetermined maximum diameter of a piston vibrator for a specific application, the advantages of this embodiment of the invention become still clearer. In this case the bore of a conventional piston vibrator would be about 19% smaller in diameter than that shown in FIG. 1, and efficiency would thereby be reduced by about 35%.

The differences are still more marked in the embodiment in FIG. 2, which shows a differential pressure piston vibrator. It will be seen that the cylindrical bore 5 of the vibrator is widened in steps, and the piston 2 also has a corresponding stepped shape in longitudinal section, with the part of the piston with a larger diameter sliding within the widened cylindrical portion 5' and the rest of the piston in the cylindrical bore 5.

A vibrator of this type has only one lateral air connection in the region of the wider cylindrical portion 5'; it is provided in an eccentrically annular projection 8. Otherwise the case of the vibrator has a uniformly smaller thickness in the region of the wider cylindrical portion 5'. The cylindrical bores 5' and 5 are again respectively asymmetric and eccentric relative to the outer wall 6 at the level of the air connection 7, since they are concentric with the rest of the case, and the annular projection 8 is arranged eccentrically on the wall 1 of the case, as will be seen clearly from FIG. 2*a* and the view from above in FIG. 2*b*. FIG. 2*c* is a section taken along the lines B—B at the level of the air connection 7 in FIG. 1*a*.

FIG. 3 shows what diameter a conventional vibrator corresponding to that in FIG. 2 would have had, with a constant wall thickness in the region of the wider cylindrical portion 5', corresponding to the wall thickness in the region of the air connection 7.

The lateral connection 7 can generally be formed by a laterally extending blind hole with a connecting bore taken through the wall of the case parallel with the axis; the bore again requires a certain minimum wall thickness.

A table follows, demonstrating the increased efficiency of the new piston vibrator, shown by way of example in FIG. 1, as compared with a conventional piston vibrator. It should be noted that performance is proportional to the particular cross-sectional area of the piston. The table refers to piston vibrators with the maximum wall thickness A=11 mm, assumed to be constant for a conventional piston vibrator, and with a minimum wall thickness B=4 mm for the new piston. Pistons with the same outside diameter are compared, with C1 giving the diameter of the bore of a conventional piston vibrator and C2 the diameter of the bore of the new capacitor.

| A = 11 mm, B = 4 mm | | |
|---|---|---|
| C1 = 1, C2 = 8, | piston area is | 64.00 times larger |
| C1 = 2, C2 = 9, | " | 20.25 times larger |
| C1 = 3, C2 = 10, | " | 11.11 times larger |
| C1 = 4, C2 = 11, | " | 7.56 times larger |
| C1 = 5, C2 = 12, | " | 5.76 times larger |
| C1 = 6, C2 = 13, | " | 4.69 times larger |
| C1 = 7, C2 = 14, | " | 4.00 times larger |
| C1 = 8, C2 = 15, | " | 3.52 times larger |
| C1 = 9, C2 = 16, | " | 3.16 times larger |
| C1 = 10, C2 = 17, | " | 2.89 times larger |
| C1 = 11, C2 = 18, | " | 2.68 times larger |
| C1 = 12, C2 = 19, | " | 2.51 times larger |
| C1 = 13, C2 = 20, | " | 2.37 times larger |
| C1 = 14, C2 = 21, | " | 2.25 times larger |
| C1 = 15, C2 = 22, | " | 2.15 times larger |
| C1 = 16, C2 = 23, | " | 2.07 times larger |
| C1 = 17, C2 = 24, | " | 1.99 times larger |
| C1 = 18, C2 = 25, | " | 1.93 times larger |
| C1 = 19, C2 = 26, | " | 1.87 times larger |
| C1 = 20, C2 = 27, | " | 1.82 times larger |
| C1 = 21, C2 = 28, | " | 1.78 times larger |
| C1 = 22, C2 = 29, | " | 1.74 times larger |
| C1 = 23, C2 = 30, | " | 1.70 times larger |
| C1 = 24, C2 = 31, | " | 1.67 times larger |
| C1 = 25, C2 = 32, | " | 1.64 times larger |

I claim:

1. A piston vibrator comprising a case with at least one cylindrical bore (5, 5'), at least one air connection (7) taken laterally to the bore (5, 5'), and a piston (2) longitudinally displaceable in the bore (5, 5'), characterized in that the cylindrical bore (5, 5') extends asymmetrically to the external wall area (6) of the case, at least at the axial level of the air connection (7), and in that the external wall area is substantially cylindrical at least at the axial level of the air connection.

2. The piston vibrator of claim 1, characterized in that the external wall area (6) of the case is cylindrical substantially over its entire length.

3. The piston vibrator of claim 1, characterized in that the external wall area (6') of the case is substantially cylindrical and concentric with the bore (5, 5'), and has an eccentrically annular projection (8) at the axial level of the air connection (7).

4. The piston vibrator of claim 1, characterized in that the air connection (7) is provided in the region of largest wall thickness of the case.

5. The piston vibrator of claim 2, characterized in that the air connection (7) is provided in the region of largest wall thickness of the case.

6. The piston vibrator of claim 3, characterized in that the air connection (7) is provided in the region of largest wall thickness of the case.

7. The piston vibrator of claim 1, characterized in that it is a differential pressure piston vibrator.

8. The piston vibrator of claim 2, characterized in that it is a differential pressure piston vibrator.

9. The piston vibrator of claim 3, characterized in that it is a differential pressure piston vibrator.

10. The piston vibrator of claim 4, characterized in that it is a differential pressure piston vibrator.

11. The piston vibrator of claim 1, characterized in that a plurality of air connections (7) are provided and are arranged one behind the other in an axial direction in the region of greatest wall thickness of the case.

12. The piston vibrator of claim 2, characterized in that a plurality of air connections (7) are provided and are arranged one behind the other in an axial direction in the region of greatest wall thickness of the case.

13. The piston vibrator of claim 3, characterized in that a plurality of air connections (7) are provided and are arranged one behind the other in an axial direction in the region of greatest wall thickness of the case.

14. The piston vibrator of claim 4, characterized in that a plurality of air connections (7) are provided and are arranged one behind the other in an axial direction in the region of greatest wall thickness of the case.

15. The piston vibrator of claim 5, characterized in that a plurality of air connections (7) are provided and are arranged one behind the other in an axial direction in the region of greatest wall thickness of the case.

16. The piston vibrator of claim 6, characterized in that a plurality of air connections (7) are provided and are arranged one behind the other in an axial direction in the region of greatest wall thickness of the case.

17. The piston vibrator of claim 7, characterized in that a plurality of air connections (7) are provided and are arranged one behind the other in an axial direction in the region of greatest wall thickness of the case.

18. The piston vibrator of claim 8, characterized in that a plurality of air connections (7) are provided and are arranged one behind the other in an axial direction in the region of greatest wall thickness of the case.

19. The piston vibrator of claim 9, characterized in that a plurality of air connections (7) are provided and are arranged one behind the other in an axial direction in the region of greatest wall thickness of the case.

20. The piston vibrator of claim 10, characterized in that a plurality of air connections (7) are provided and are arranged one behind the other in an axial direction in the region of greatest wall thickness of the case.

21. The piston vibrator of claim 11, characterized in that it comprises a piston (2) with a substantially constant diameter.

22. The piston vibrator of claim 12, characterized in that it comprises a piston (2) with a substantially constant diameter.

23. The piston vibrator of claim 13, characterized in that it comprises a piston (2) with a substantially constant diameter.

24. The piston vibrator of claim 14, characterized in that it comprises a piston (2) with a substantially constant diameter.

25. The piston vibrator of claim 15, characterized in that it comprises a piston (2) with a substantially constant diameter.

26. The piston vibrator of claim 16, characterized in that it comprises a piston (2) with a substantially constant diameter.

27. The piston vibrator of claim 17, characterized in that it comprises a piston (2) with a substantially constant diameter.

28. The piston vibrator of claim 18, characterized in that it comprises a piston (2) with a substantially constant diameter.

29. The piston vibrator of claim 19, characterized in that it comprises a piston (2) with a substantially constant diameter.

30. The piston vibrator of claim 20, characterized in that it comprises a piston (2) with a substantially constant diameter.

* * * * *